US005114364A

United States Patent [19]

Hunter

[11] Patent Number: 5,114,364

[45] Date of Patent: May 19, 1992

[54] SHIELDED CONNECTOR

[75] Inventor: Stephen B. Hunter, Kinross, United Kingdom

[73] Assignee: W. L. Gore & Associates, Inc., Newark, Del.

[21] Appl. No.: 654,157

[22] Filed: Feb. 12, 1991

[30] Foreign Application Priority Data

Feb. 13, 1990 [GB] United Kingdom ..... 9003214.8

[51] Int. Cl.[5] ..... H01R 9/07

[52] U.S. Cl. ..... 439/497; 439/76; 439/607

[58] Field of Search ..... 439/55, 76, 492, 497, 439/498, 499, 78, 79, 607-610

[56] References Cited

U.S. PATENT DOCUMENTS 4,138,711 2/1979 Bremenour et al. ..... 439/76
4,337,989 7/1982 Asick et al. ..... 439/609
4,422,709 12/1983 Croci et al. ..... 439/76
4,731,031 3/1988 Lemke ..... 439/607
4,823,235 4/1989 Suzuki et al. ..... 439/76
4,993,971 2/1991 Matsuzaki et al. ..... 439/607
5,005,106 4/1991 Kiku ..... 439/610

*Primary Examiner*—David L. Pirlot
*Attorney, Agent, or Firm*—Gary A. Samuels

[57] ABSTRACT

A minature connector capable of providing an electrically shielded connection at close pin spacings comprises a double sided printed circuit board (PCB) having parallel tracks etched on an upper surface and contacts soldered thereto. A screening shell having insulation material on an inner surface encloses the PCB end contacts and is electrically connected to the edges of the undersurface of the PCB to complete a rectangular-section screening casing. A stack of such assemblies is enclosed in a grouper housing to form, for example, a six by four connector array which is electrically shielded.

12 Claims, 3 Drawing Sheets

SHIELDED CONNECTOR

FIELD OF THE INVENTION

This invention relates to a minature shielded connector for connecting the wires of a cable to the appropriate pins of a printed circuit board (PCB) backplane having an array of connection pins. It is useful for making board-to-board connections. It is particularly (though not exclusively) concerned with providing such a connector which is capable of making a shielded connection to pins forming part of a matrix of pins arranged in a grid having a 2 mm pitch spacing.

BACKGROUND OF THE INVENTION

An example of such a pin system is the Dupont Metral (trademark) 2 mm grid system in which the pins are arranged in four rows in a variety of configurations for PCB/cable interconnection. A typical metal connector comprises a 6×4 grid of pin sockets arranged at a spacing of 2 mm. However, such connectors are not shielded.

Most conventional backplane pin connection systems are based on a pin spacing of 0.1 inches (2.54 mm), but existing shielded connector designs, which generally involve the use of extruded insulators and other parts with relatively thick walls, do not scale down to provide a satisfactory 2 mm equivalent.

It is an object of the present invention to provide a shielded connector construction capable of being produced at small pin spacings.

SUMMARY OF THE INVENTION

According to the invention there is provided a shielded connector for connecting a cable to a backplane having at least one row of parallel connection pins, the connector comprising a support plate of insulating material carrying a number of parallel pin socket contacts on one face and an electrically conductive layer forming a ground plane on the other face of the plate, the pin socket contacts being electrially connected to respective wires of the cable, and a screening shell joined to the support plate to form a casing of rectangular cross-section enclosing the pin socket contacts, the screening shell comprising an electrically conductive outer layer which is electrically connected to the ground plane layer of the support plate, and an inner layer of an insulating material.

The electrically conductive outer layer of the screening shell and the ground plane layer of the support plate together provide the connector with full electro-magnetic interference (EMI) shielding, an essential requirement for systems designed to operate at relatively high frequencies. Furthermore, the construction enables a shielded connector to be produced which is compatible with a pin spacing of 2 mm, and the rectangular cross-sectional shape of the connector casing renders the connector readily stackable with adjacent similar connectors to enable several cables to be connected to a backplane provided with a grid matrix of connection pins.

DETAILED DESCRIPTION OF THE DRAWINGS

DETAILED DESCRIPTION OF THE INVENTION

Figure 1:
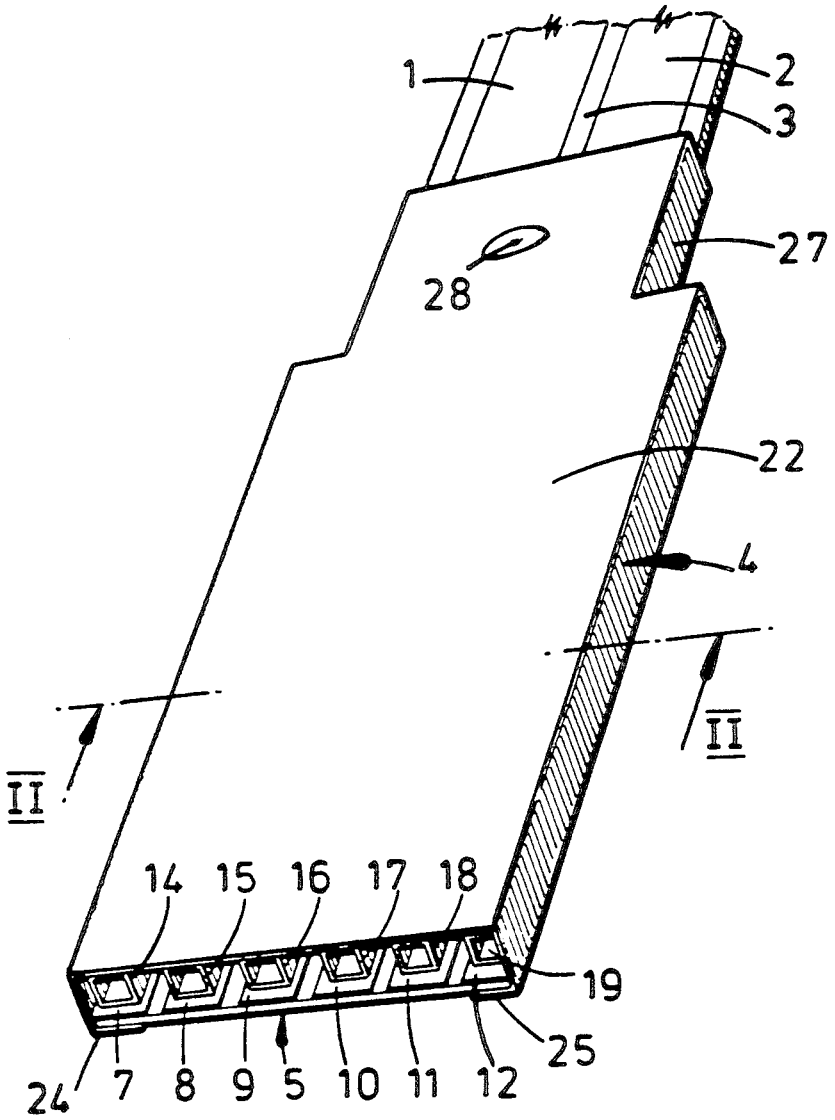
FIG. 1 is a perspective view of the connector.

Preferably the pin socket contacts are mounted on separate electrically conductive strips or tracks provided on the support plate, and the wires of the cable are connected to the respective tracks, for example by soldering.

Conveniently, the support plate may be formed by a double sided printed circuit board (PCB) substrate, the electrically conductive layer of one face being removed selectively to leave the required tracks for the pin socket contacts and cable wires.

In cases where the cable includes a ground wire or a drain wire terminating screening within the cable, the respective track of the support plate is preferably electrically connected to the ground plane layer of the plate by means of an electrically conductive lining in a hole formed through the plate between the track and the ground plane layer.

The electrically conductive outer layer of the screening shell is preferably made of metal, e.g. brass, and the insulating inner layer is preferably formed by pre-preg material which is bonded to the outer layer. The pre-preg material is conveniently an expanded PTFE material impregnated with a thermosetting resin, such as the material available from W.L. Gore & Associates (U.K.) Ltd. under the trademark GOREPLY. The insulating layer preferably covers at least that portion of the outer layer which forms the casing wall opposite that formed by the support layer, and preferably also covers those portions forming the side walls of the casing.

The pin socket contacts may comprise sockets preferably each of tubular form having a substantially square cross-section and a waisted central portion so that, in use, the respective connection pin will be held firmly by the socket to ensure good electrical contact therebetween.

As shown in the drawings, the connector is designed to connect two flat, high frequency, differential signal cables 1, 2 to a row of six connection pins of a grid matrix having a pitch of 2 mm.

Figure 3:
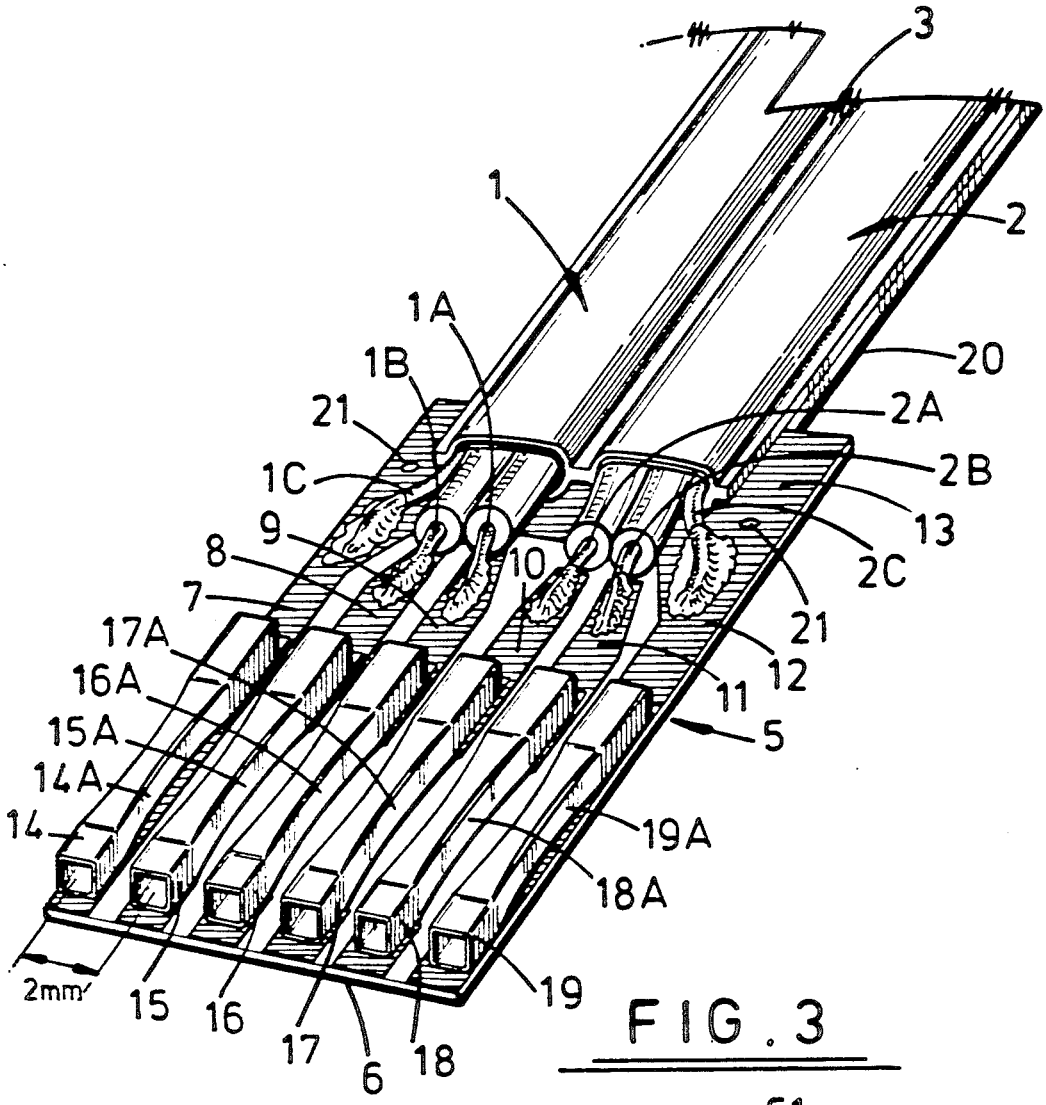
FIG. 3 is a perspective view of the connector before its screening shell is fitted.

As best shown in FIG. 3, each cable 1, 2 comprises two insulated, differential signal wires 1A, 1B and 2A, 2B, and EMI screening terminating in a ground or drain wire 1C, 2C. The sheaths of the two cables 1 and 2 are joined by a central web 3 to form a flat, parallel pair cable having a plane of symmetry in which lie the axes of the cable wires 1A, 1B, 1C and 2A, 2B and 2C. Within each connector the signal wires are generally arranged in the order ground − + − + − ground or vice versa.

Figure 2:
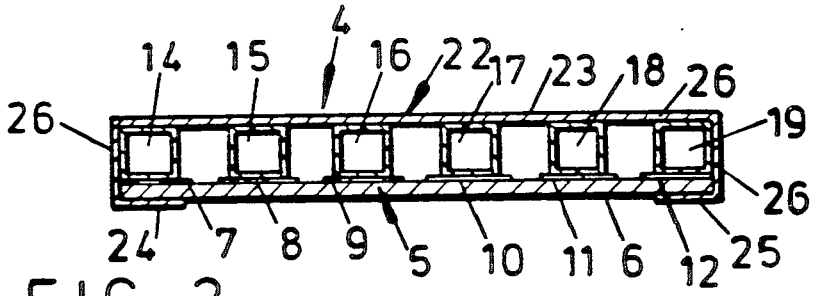
FIG. 2 is a cross-sectional view of the line II—II of FIG. 1.

As illustrated in FIGS. 1 to 3, the cable pair 1, 2 is terminated by a female connector 4 according to the invention comprising a support or base plate 5 formed by a thin, double sided PCB substrate of which the electrically conductive coating layer on the under side forms a continuous ground plane layer 6, and the electrically conductive coating layer on its upper side is etched to leave six parallel, longitudinally extending electrically conductive tracks 7, 8, 9, 10, 11 and 12 spaced uniformly apart across the base plate 5. The two outermost tracks 7 and 12 are interconnected by a transverse band 13 of the upper electrically conductive coating layer at the rear end of the base plate 5, and the four intermediate tracks 8, 9, 10 and 11 are isolated from each other and from the outer tracks 7 and 12 and are each divided into two longitudinally spaced portions.

Permanently mounted longitudinally on the tracks 7 to 12 near the front of the base plate 5, and in electrical contact with the tracks, are six square sectioned tubular pin sockets 14, 15, 16, 17, 18 and 19 which are arranged parallel to each other with their axes spaced at 2 mm intervals. Each pin socket is made of metal, e.g. copper or brass, and has a waisted central portion 14A, 15A, 16A, 17A, 18A and 19A providing inwardly bowed resilient side walls for gripping and ensuring a good electrical contact between the socket and a pin received therein. As can be seen in FIG. 3, the four intermediate pin sockets 15, 16, 17 and 18 are mounted on the base plate 5 so as to bridge the spaced portions of the respective tracks 8, 9, 10 and 11.

The end of the cable pair 1, 2 is laid on the rear end of the base plate 5, which has a rearwardly extending portion 20 of reduced width, and the wires 1A, 1B and 1C of the cable 1 are soldered or welded to the rear portions of the tracks 9, 8 and 7 respectively, and the wires 2A, 2B and 2C of the cable 2 are welded or soldered to the rear portions of the tracks 10, 11 and 12 respectively.

The support plate 5 is provided with a pair of through holes 21 in the region of the conductive band 13 on the upper surface, and these holes are provided with an electrically conductive lining which electrically interconnects the ground plane 6 on the under side of the base plate 5 and the tracks 7 and 12 on the upper surface to which the ground wires 1C and 2C of the cables 1 and 2 are connected.

The connector 4 is completed by a screening shell 22 (FIGS. 1 and 2) which is placed over the pin sockets 14 to 19 and the end of the cable pair 1, 2 and is fixed to the base plate 5 to form a casing of rectangular cross-section (as shown in FIG. 2) enclosing the pin sockets and the ends of the cable wires which are soldered to the tracks 7 to 12 on which the pin sockets are mounted. The casing shell 22 comprises a metallic outer layer 23, e.g. of brass, having edge portions 24 and 25 which overlap the underside of the base plate 5 adjacent the side edges thereof and are suitably secured thereto so that the portions 24 and 25 are in electrical contact with the ground plane 6. The ground plane 6 and the outer layer 23 of the casing shell 22 thus form an EMI shield around the entire connector. On the inside of the casing shell 22 a lining 26 of a non-woven pre-preg material made by W.L. Gore & Associates (U.K.) Ltd. and available under the trademark GOREPLY is bonded to the metallic outer layer 23 to form an insulating layer extending over the top of the pin sockets 14 to 19 and along the outer sides of the two outermost sockets 14 and 19.

As shown in FIG. 1, the casing shell 22 has a reduced width portion 27 surrounding the end portion of the cable pair 1, 2 leading into the connector 4 and overlying the rear portion 20 of the base plate 5, and the cable pair and the connector are firmly secured together by means of a rivet 28 extending through the shell portion 27, the web 3 of the cable pair, and the base plate portion 20. The reduced portion 27 improves the coupling between the cable screen and the sheath to maximize the screening effect of the shell.

Figure 4:
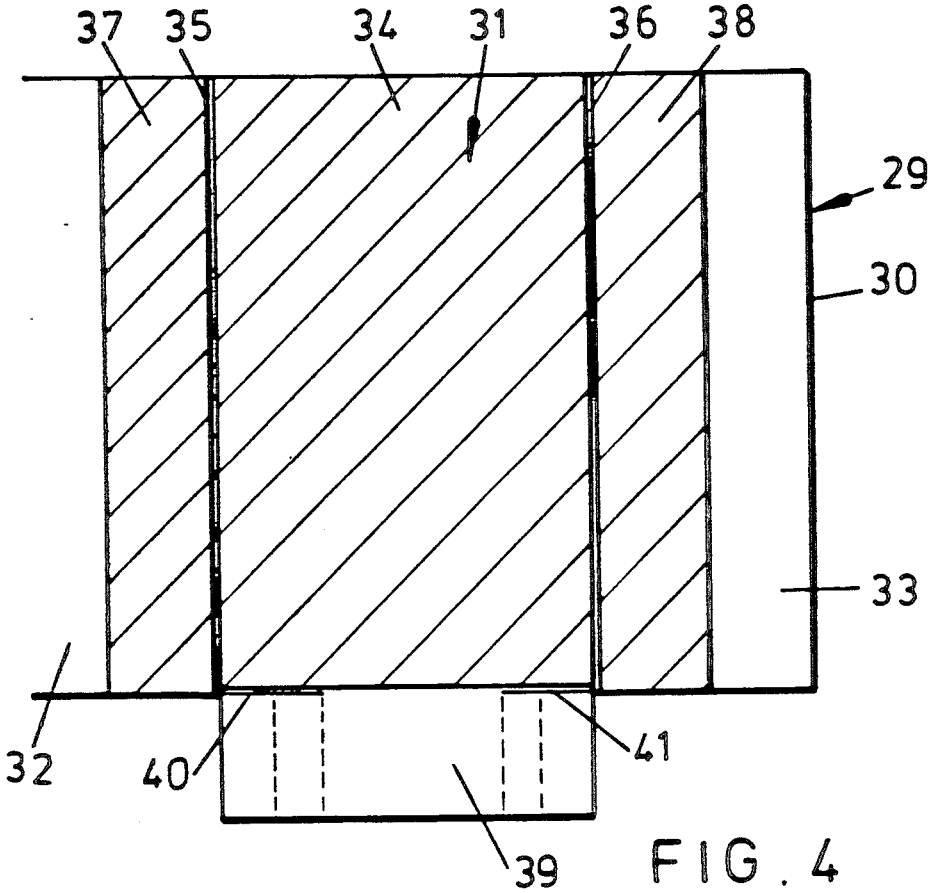
FIG. 4 is a plan view of a screening shell blank prior to being folded to form the shell.

The casing shell 22 may conveniently be formed from a flat blank which is folded and secured in position upon assembly with the base plate 5 having the cables and pin sockets mounted thereon. The casing blank 29 is illustrated in FIG. 4, and comprises a thin, metallic sheet 30 of the shape shown and having a rectangular portion on which an insulating layer 31 of pre-preg material is bonded leaving edge strips 32, 33 of the metallic sheet 30 clear for forming the portions 24 and 25 which are folded under the base plate 5 and bonded in contact with the ground plane 6 thereof. The insulating layer 31 has a central portion 34 of a width equal to that of the base plate 5 separated on each side by a small gap 35, 36 from edge portions 37 and 38 of width slightly greater than the height of the pin sockets which are mounted on the base plate. The gaps 35, 36 facilitate the folding of the blank 29 as necessary during assembly of the connector casing, and may be formed by removing narrow strips of the insulating material 31 from the blank 29 along the intended fold lines in any suitable manner, for example using a laser. At one end of the blank 29 the central portion of the metallic sheet 30 is continued to form a flap 39 for the purpose of forming the reduced width casing portion 27 surrounding the lead-in portion of the cable pair 1, 2. For this purpose the flap 39 is slit inwardly from each outer edge along the junction line with the main portion of the metallic sheet 30 as shown at 40 and 41, thus allowing the edge portions of the flap 39 to be folded as necessary during assembly of the connector. The metallic sheet 30 may be scored along the intended fold lines to facilitate folding during assembly.

In this embodiment a typical thickness for the base plate 5 will be about 0.01 inches (0.25 mm), and the outer metallic layer of the casing shell 22 will have a thickness in the region of 0.003 to 0.004 inches (0.076 to 0.102 mm). The thickness of the insulating layer 26 of the casing shell 22 may be in the region of 0.15 mm, and the cross-sectional dimensions of the pin sockets may be about 1 mm. This will provide a connector with overall cross-sectional dimensions of about 11.5 mm by about 1.6 mm, thus enabling the connector to be connected to a row of six pins in a grid of 2 mm pitch with sufficient clearance to allow similar connectors to be connected to adjacent rows of six pins both alongside and on top of the first connector. Obviously, the dimensions of the components may be varied within the overall constraints of the 2 mm pitch with which the connector is to be compatible, and the connector may also be scaled down or up to suit pin pitches other than 2 mm.

Figure 6:
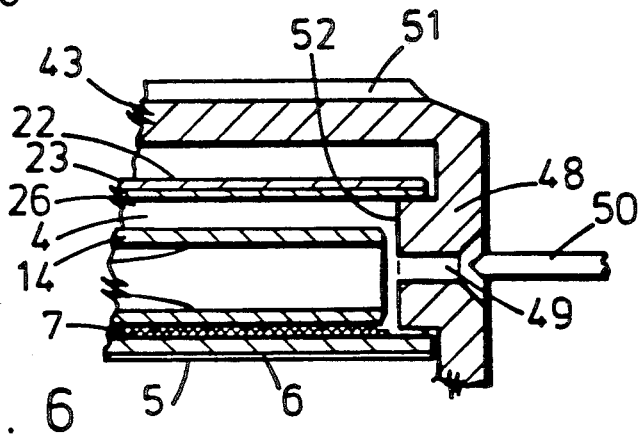
FIG. 6 is a part cross-section along the line VI—VI of FIG. 5.
Figure 5:
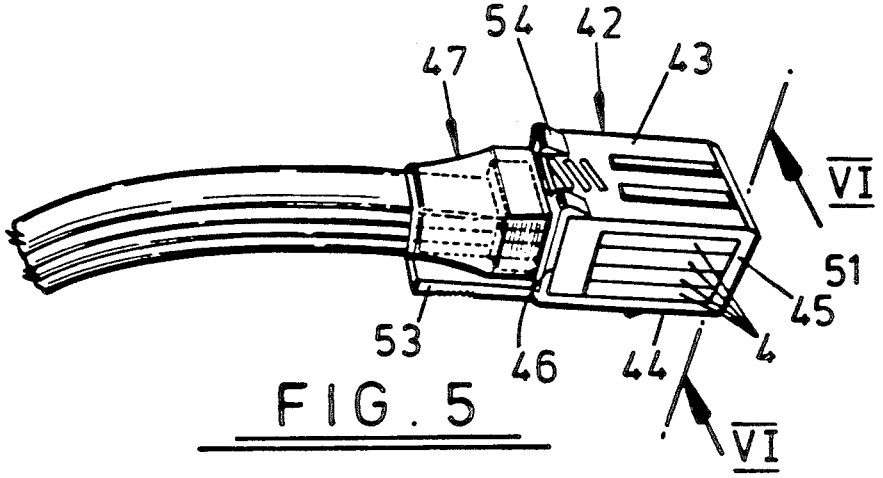
FIG. 5 is a perspective view of a grouper in which four connectors similar to those of FIGS. 1 to 4 are stacked together one on top of the other.

As mentioned earlier, the connector illustrated is designed for use with a 2 mm grid matrix of pins such as that employed by the Dupont Metral 2 mm system. In this system the smallest unit comprises a block of twenty four pins arranged in four rows of six. FIGS. 5 and 6 illustrate a grouper 42 which clamps four identical connectors 4 one above the other in position for connection directly to the pin block, thus connecting four cable pairs (eight differential cable lines) simultaneously to the backplane. The grouper 42 comprises upper and lower walls 43, 44 interconnected at the front and rear corners by upright walls 45, 46 respectively. The grouper is formed of a resilient plastics material and is folded around the stack of connectors 4 after attachment of cables thereto until nibs 54 snap around the upper wall 43 so as to hold the grouper in place. The front face 48 of the grouper is of course provided with openings 49 to allow access of the connectors to the connection pins 50 of the backplane, and is provided on its inside face with ridges 52 which locate within the open ends of the respective shells 22 thus holding the shells in position. The side walls of the grouper are also open in order to keep the overall width of the assembly below a maximum value of 11.95 mm so as to avoid difficulties in connecting similar groups of connectors side by side to the pins of the backplane. The upper and lower walls of the grouper 42 may be provided with key ways 51 and latching components 53 compatible with the Metral system. The rear end of the grouper is preferably provided with a shrink tail 47 surrounding the lead-in portions of the cables and connectors in order to reduce the strain imposed on these portions.

Although the invention has been described herein in relation to a female connector, it will, of course, be appreciated that it is equally applicable to a male connector in which the pin sockets will be replaced by appropriate pins for connection to respective sockets carried by the backplane.

I claim:

1. A shielded connector for connecting a cable or cables to a backplane having at least one row of parallel connection pins, the connector comprising a support plate of insulating material carrying a number of spaced parallel pin socket contacts on one face thereof and an electrically conductive layer forming a grounded plane on the other face thereof, the pin socket contacts being adapted for electrical connection to respective wires of said cable or cables, and a screening shell joined to the support plate to form a casing of rectangular cross section enclosing the pin socket contacts, the screening shell comprising an electrically conductive outer layer which is electrically connected to the ground plane layer of the support plate and an inner layer of an insulating material, said screening shell embracing transversely opposed edges of the support plate such that corresponding edge portions of the screening shell underlie the opposed support plate edge portions and such that insulating material is absent from the screening shell edge portions in a manner such that electrical contact is made between the screening shell and the electrically conductive layer on said other face of the support plate.

2. A connector according to claim 1 wherein the support plate is formed of double-sided printed circuit board, which has been etched on said one face to provide tracks on which the respective contacts are mounted in electrical contact therewith.

3. A connector according to claim 1 wherein the screening shell is formed of conductive metal and the inner layer of insulating material comprises expanded polytetrafluorethylene impregnated with a thermosetting resin.

4. A connector according to claim 1 wherein the spaced parallel pin socket contacts have two outermost pin socket contacts that are electrically interconnected and adapted to be attached to ground wires of a pair of cables attached to the connector.

5. A connector according to claim 1 wherein the pin contacts are spaced apart at 2 mm centres.

6. A connector according to claim 1 wherein the screening shell has a rearwardly extending portion in a rearward reduced width region of the support plate adapted for attachment of the cable or cables to the support plate.

7. A connector according to claim 1 which is compatible with the METRAL (trademark) 2 mm spacing connector protocol.

8. A shielded connector for connecting a cable or cables to a backplane having at least one row of parallel connection pins, which connector comprises a group of assemblies arranged in a stack and held within a grouper housing, each assembly comprising a support plate of insulating material carrying a number of spaced parallel pin socket contacts on one face thereof and an electrically conductive layer forming a ground plane on the other face thereof, the pin socket contacts being adapted for electrical connection to respective wires of said cable or cables and a screening shell joined to the support plate to form a casing of rectangular cross-section enclosing the pin socket contacts, the screening shell comprising an electrically conductive outer layer which is electrically connected to the ground plane layer of the support plate and an inner layer of an insulating material;

said grouper housing holding together the stack of assemblies such that the pin socket contacts are held in an array.

9. A connector according to claim 8 wherein the grouper housing is formed of a resilient material and is adapted to be fitted around the stock of assemblies after attachment of respective cables thereto.

10. A connector according to claim 8 wherein the screening shell and support plate of each assembly protrudes forwardly of the parallel pin socket contacts, and wherein the grouper housing comprises a front end portion to allow electrical contact with the respective pin socket contacts through said end portion, the end portion comprising a plurality of ridges along its inner face, each ridge locating within said forwardly protruding portion of a respective screening shell support plate assembly such as to hold the assemblies in position within the grouper housing.

11. A connector according to claim 8 wherein the grouper housing is open at either lateral side thereof to enable a plurality of such connectors to be connected side-by-side to the backplane at minimal mutual spacing.

12. A connector according to claim 8 which is compatible with the METRAL (trademark) 2 mm spacing connector protocol.

* * * * *